US005575395A

United States Patent [19]

Alaj ä äski et al.

[11] Patent Number: 5,575,395

[45] Date of Patent: Nov. 19, 1996

[54] METHOD AND APPARATUS FOR SCREENING FIBROUS SUSPENSIONS

[75] Inventors: Timo Alajääski, Kotka; Kaj Henricson, Helsinki; Kalevi Laakso, Karhula; Antero Laine, Kotka; Risto Ljokkoi, Karhula; Olavi Pikka, Karhula; Markku Simola, Helsinki, all of Finland; Pertti Wathén, Queensbury, N.Y.

[73] Assignee: A. Ahlstrom Corporation, Noormarkku, Finland

[21] Appl. No.: 275,343

[22] Filed: Jul. 15, 1994

[51] Int. Cl.[6] ..... B03B 7/00

[52] U.S. Cl. ..... 209/17; 209/270; 209/273

[58] Field of Search ..... 209/17, 250, 270, 209/264, 273, 306, 208; 210/512.3, 413, 415

[56] References Cited

U.S. PATENT DOCUMENTS

| | | | |
|---|---|---|---|
| 3,677,402 | 7/1972 | Holz . | |
| 3,785,495 | 1/1974 | Holz . | |
| 3,865,243 | 2/1975 | Salminen . | |
| 3,898,157 | 8/1975 | Hooper . | |
| 3,933,649 | 1/1976 | Ahlfors | 209/270 X |
| 4,504,016 | 3/1985 | Wikdahl | 209/17 X |
| 4,634,521 | 1/1987 | Simola et al. . | |
| 4,776,957 | 10/1988 | Lampenius et al. . | |
| 4,915,822 | 4/1990 | Ljokkoi . | |
| 4,927,529 | 5/1990 | Henricson et al. . | |
| 4,950,402 | 8/1990 | Frejborg . | |
| 5,000,842 | 3/1991 | Ljokkoi . | |
| 5,078,859 | 1/1992 | Satomi | 209/17 |
| 5,112,444 | 5/1992 | Henricson et al. | 209/273 X |
| 5,119,953 | 6/1992 | Atkeison, III et al. | 209/273 |
| 5,147,543 | 9/1992 | Frejborg . | |
| 5,172,813 | 12/1992 | Ljokkoi . | |

FOREIGN PATENT DOCUMENTS

| | | |
|---|---|---|
| 0506753 | 9/1993 | European Pat. Off. . |
| 79394 | 12/1989 | Finland . |

*Primary Examiner*—David H. Bollinger
*Attorney, Agent, or Firm*—Nixon & Vanderhye, P.C.

[57] ABSTRACT

A fiber suspension, such as an in a pulp mill, is treated in an manner which minimizes both the investment and the operating costs associated with a screening plant. A single pump has an outlet connected to a knotter and primary and secondary screening states so that the pump provides substantially the sole motive force to the pulp moving it through the knotter and screening stages. The knotter and screening stages are provided in a common housing with the knotter vertically above the screening stages, and the screening stages one above the other. A single motor may be provided to rotate rotatable elements associated with the knotter and screening stages. The knotter may be connected to a knot washer external of the housing by a valved conduit less than two meters in length, and the secondary screening stage can be connected to a tertiary screening stage exterior of the housing by a valved conduit less than two meters long. Rejects from the knot washer and secondary screening stage may be recycled to the pulp inlet, and dilution water may be introduced where necessary.

36 Claims, 9 Drawing Sheets

METHOD AND APPARATUS FOR SCREENING FIBROUS SUSPENSIONS

BACKGROUND AND SUMMARY OF THE INVENTION

In conventional pulp mills the facilities for screening of pulp require both high capital investment and have high operating costs. Typically different components in the screening plant are connected to each other by long pipes, each piece of apparatus being independent of the other. Usually a number of centrifugal pump are utilized for pumping the fiber suspension from one station to another to ensure continuous flow and treatment. Each piece of equipment is normally designed only for one purpose, and the layout of the screen room takes up significant floor space. Typical equipment that is utilized includes knotters, such as shown in U.S. Pat. No. 4,927,529, knot washers such as shown in European published Patent Application 93890042, and pressure screens such as shown in U.S. Pat. Nos. 4,634,521, 4,776,957, 4,915,822, 4,950,402, 5,000,842, 5,147,543, and 5,172,813. The disclosures of these prior patents are hereby incorporated by reference herein as types of exemplary equipment that may be utilized in the novel and advantageous arrangement and method according to the present invention.

One of the pieces of equipment described above, namely in U.S. Pat. No. 4,634,521, removes light rejects from the pump being treated. A cylindrical screen drum is provided which rotates a vertically disposed dome-shaped cylindrical rotor. The volume inside the rotor is operatively connected with the pump treatment of reject space between the screen cylinder and the rotor. When this equipment is dismantled the rotor is found to be filled with plastic and other light-weight and unwanted material, therefore a pipe is disposed inside the rotor to extend close to the top of the rotor to allow the rejects to flow into the pipe away from the rotor.

There are some patents that teach apparatus which performs a plurality of functions. For example, pressure screens are shown in U.S. Pat. Nos. 3,677,402, 3,785,495, 3,865,243 and 3,898,157 (the disclosures which are hereby incorporated by reference herein) which disclose two sorting stages disposed within the same housing. For example U.S. Pat. No. 3,677,402 discloses an apparatus including a stationary screen cylinder and a rotor rotating inside the screen cylinder. The rotor surface is provided with openings substantially larger than the openings of the screen cylinder. Additionally, the top portion of the rotor extend above the screen cylinder. As the pulp to be treated is introduced into the apparatus it is first divided into two fractions by means of the top portion of the rotor surface which thereby rejects the larger sized particles to be discharged from the apparatus. The accept portion of the fiber suspension flows inside the rotor from where it, due to centrifugal forces, flows back through the rotor surface towards the screen cylinder so that the accept portion flows through said screen surface outside thereof and the reject portion remains inside the screen surface to be discharged from the apparatus.

Equipment is also known in which a screening unit is combined with a centrifugal cleaner.

By using some of the equipment as described above, the layout and investment costs of a screen room can be improved somewhat. However, typically such arrangements only eliminate one pump and one screen, meaning that there is still a need for a plurality of pumps with consumption of excessive floor space.

According to the present invention a fiber suspension treatment apparatus, and method of screening cellulose pulp, are provided which are extremely advantageous compared to the typical prior art as described above. The investment and operating costs of a screening plant utilizing the apparatus according to the invention can be only a fraction of what they are in the conventional art, yet there is no sacrifice in functionality.

According to one aspect of the present invention a fiber suspension treatment apparatus is provided comprising the following elements: A single pump having an inlet and an outlet. A knotter. A primary screening stage. A secondary screening stage; and the single pump outlet connected to the knotter and screening stages to provide substantially the sole motive force to a fiber suspension to move the fiber suspension through the knotter and screening stages.

Preferably the knotter and screening stages are disposed within the same housing, and define a continuous pathway for fiber suspension within the housing extending from the knotter to the primary screening stage, and then to the secondary screening stage. The knotter rejects discharge is typically connected to a knot washer external of the housing, and the accepts of the knot washer are connected to the pump inlet. A recycle conduit is also typically provided from the secondary screening stage to the pump inlet, the recycle conduit having a length of less than two meters. In fact, essentially all of the conduits utilized in the practice of the invention have a length which is less than two meters, preferably less than 1 meter.

A tertiary screening stage may be connected to the rejects outlet with the accept outlet from the tertiary screening stage is connected to the pump inlet. A single motor may be provided for simultaneously powering the knotter and the screening stages, such as by being connectable to rotatable elements of the knotter and screening stages. The knotter is typically located immediately vertically above the first screening stage, which in turn is immediately above the second screening stage. Valves are typically provided in the conduit extending from the common housing to external equipment such as the knot washer and tertiary screening stage.

According to another aspect of the present invention a fiber suspension treatment apparatus is provided comprising the following elements: A housing. A knotter disposed in the housing and having a first rotatable element. A primary screening stage disposed in the housing and having a second rotatable element. A secondary screening stage disposed in the housing and having a third rotatable element. A first accepts discharge leading from the knotter directly to the primary screening stage, and a first rejects discharge. A second accepts discharge leading from the primary screening stage directly to the secondary screening stage, and a second rejects discharge. And, a third accepts discharge from the secondary screening stage, and a third rejects discharge.

The rotatable elements are typically disposed in a straight line arrangement and are driven by a common drive, preferably a single motor disposed on a top portion of the housing and connected to the rotatable elements by drive belts. The first rejects discharge is connected to a knot washer exterior of the housing and the third rejects discharge is connected to a tertiary screening stage exterior of the housing, both by valved conduits having a length less than two meters. The primary screening stage may comprise first, second and third screening stages, the accepts from one stage leading to the next.

According to yet a further aspect of the present invention a method of screening cellulose pulp is provided which comprises the following steps: (a) pressurizing cellulose pulp to a first pressure which is higher than a discharge pressure for the pulp; (b) under substantially the sole influence of the first pressure, without repressurizing, effecting deknotting, primary screening, and secondary screening of the pulp in knotting, primary screening, and secondary screening sequential stages; and (c) positioning the stages so that each stage is less than two meters from the next stage.

There might also be the further step of discharging rejects from the knotting and passing the rejects to a knot washer substantially solely under the influence of the first pressure, without repressurizing. Also there may be the further step of discharging rejects from the primary and secondary screening stages substantially solely under the influence of the first pressure, without repressurization. Rejects may be recirculated from the secondary screening stage and the accepts from the knot washer, back to the deknotting stage substantially solely under the influence of the first pressure. Dilution liquid is also typically fed into the pulp and at least one of the deknotting and primary and secondary screening stages, and typically all of them.

It is a primary object of the present invention to minimize the capital investment and operating cost for screening of pulp. This and other objects of the inventions will become clear from an inspection of the detailed description of the invention, and from the appended claims.

DETAILED DESCRIPTION OF THE DRAWINGS

Figure 1:
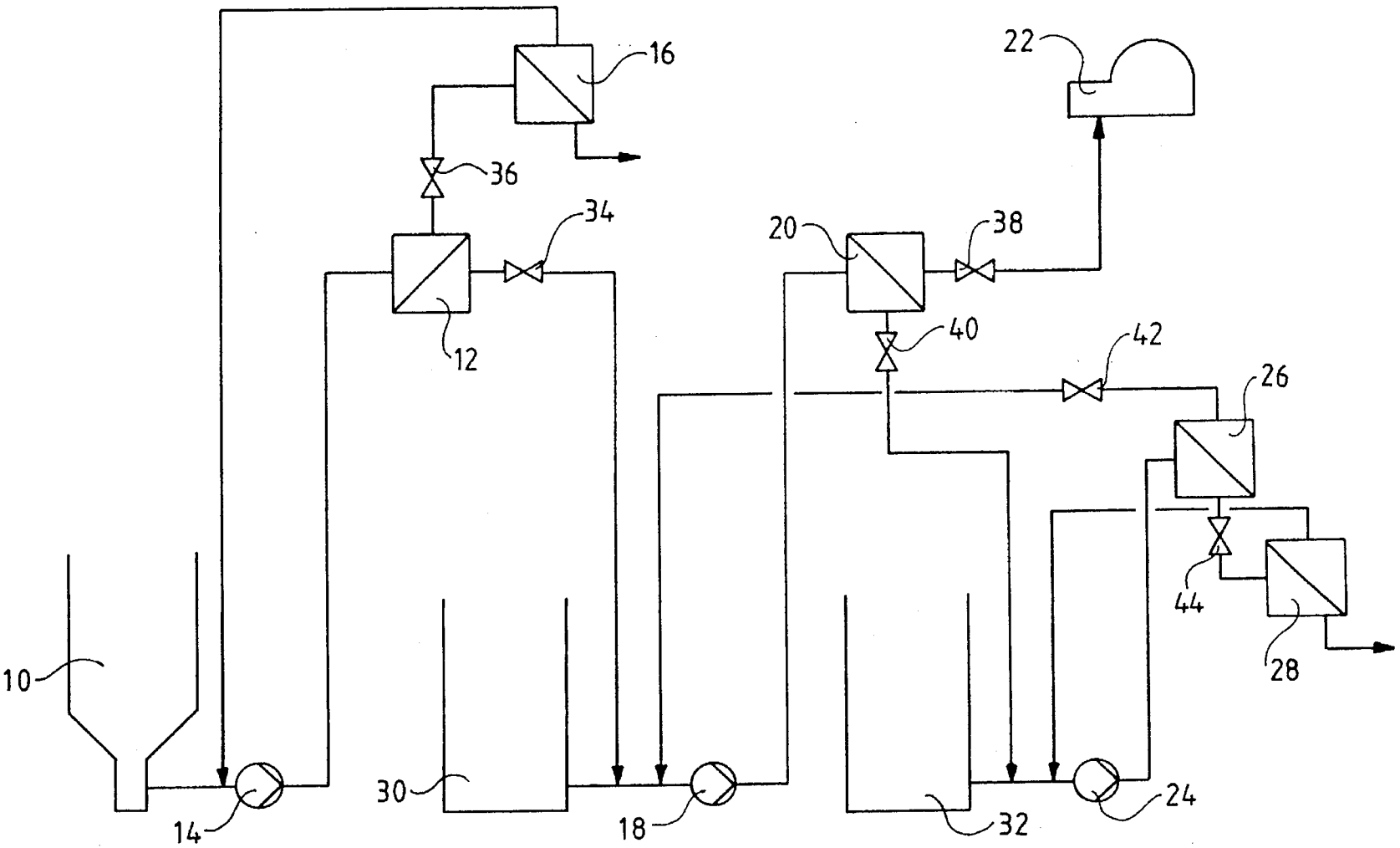
FIG. 1 PRIOR ART
FIG. 1 is a schematic illustration of an exemplary prior art system for treating fiber suspension in a screening room of a pulp mill.

FIG. 1 schematically illustrates a known prior art equipment layout for treating fiber suspensions in a screening room of a pulp mill. The pulp to be treated is introduced into the screening from the preceding treatment stage, for instance, a storage tower 120. The fiber suspension may also be brought directly from the preceding treatment stage without any storage therebetween. The pulp is first introduced into a coarse screen (knotter) 12, such as shown in U.S. Pat. No. 4,927,529 (which is incorporated herein by reference herein) by means of a pump 14. The rejects from the knotter 12 are introduced into a knot washer 16, shown for instance in an EP patent application 93890042 (incorporated herein by reference). The goal of the pulp treatment in the knot washer 16 is to wash finer fiber material attached to the knots and shives out and to recycle it for further treatment. In FIG. 1 the accepted finer fiber material is brought back in front of the pump 14 to be re-introduced into the knotter 12. Rejected knots, etc., are discharged from the stocker (knot washer) 16 to be disposed of, for instance by combustion.

The accept fraction of the knotter 12 is pumped, preferably by means of a centrifugal pump 18, to a primary screen 20 which is preferably a pressure screen like the ones described for instance in U.S. Pat. Nos. 4,634,521, 5,000,842 and 5,172,813. The accepts of the primary screen 20 are most often introduced into a thickener 22. The reject fraction of the primary screen 20 is pumped with a centrifugal pump 24 to a secondary screen 26, the screening apparatus being in principle similar to the primary screen 20. The accepts of the secondary screen 26 are fed upstream of the primary screen 20, preferably in front of the pump 18, and the rejects of the secondary screen 26 are oftentimes introduced to a tertiary screen 28.

The accepts of the tertiary screen 28 are introduced into the inlet of the secondary screen 26, preferably in front of the pump 24. The rejects of the tertiary screen 28 are discharged out of the screening room, e.g., to be burned.

Often the accepts of the knotter 12 and the rejects from the primary screen 20 have been thickened so that they must be diluted prior to introduction into the next treatment stage. Therefore dilution liquid tanks 30, 32 respectively, are provided at the inlets of the pumps 18, 24, respectively. Often the dilution liquid is received from the thickener 22, i.e., the filtrate thereof or from the fourdrinier of a paper machine.

The prior art screening room in accordance with FIG. 1 includes three centrifugal pumps 14, 18 and 24, four (preferably pressurized) screens 12, 20, 26 and 28, and a stocker 16, each piece of equipment having its own electric drive unit, i.e., eight electric motors and five reduction gear assemblies (for the screening devices). Additionally, the primary and the secondary screening circuits are provided with tanks 30 and 32 for dilution liquid. Also all the knotter 12 and the primary and the secondary screen units 20, 22 need valves 34, 36, 38, 40, 42, 44 for regulating the flow in both the accept and the reject lines. Also due to the numerous separately mounted structures piping from one unit to another unit is long, and for practical reasons the apparatus is installed such that the knotter, stocker and the pressure screens are located one story higher than the storage tower 10 dilution liquid tanks 30, 32 and pumps 14, 18 and 24, whereby the pulp travels between the ground floor and the second floor of the screening room.

Figure 2:
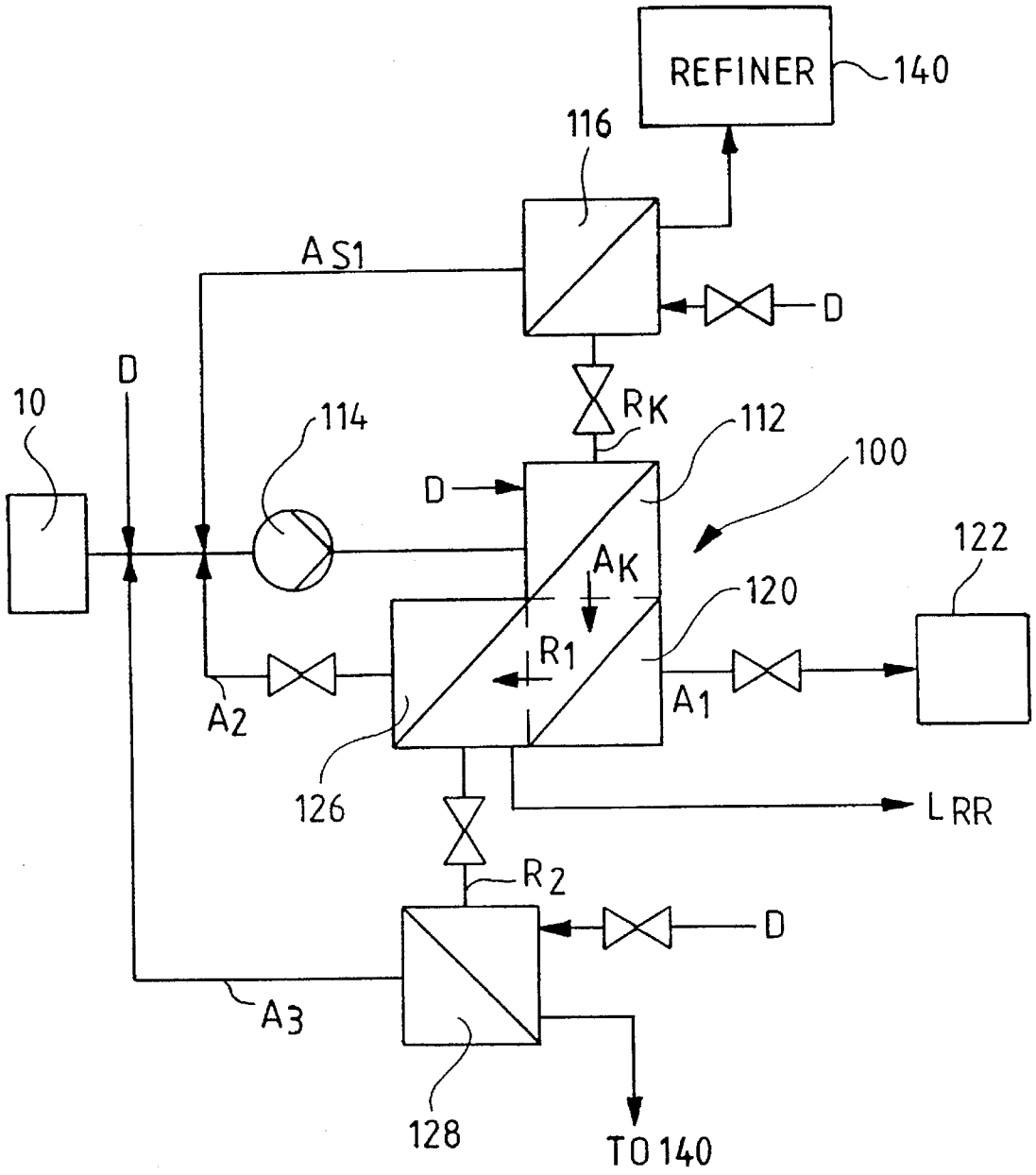
FIG. 2 is a schematic illustration of the layout of exemplary screening apparatus according to the present invention which takes the place of the apparatus in FIG. 1.

FIG. 2 schematically illustrates the layout of a screening room, or a screening plant, in accordance with a first embodiment of the present invention. In FIGS. 2 through 9 components functionally comparable to those in the prior art construction of FIG. 1 are shown by the same reference number only preceded by "1."

The pulp (e.g., at a consistency of ½–10%, typically about 1–3%) is introduced into this novel screening apparatus 100 by means of a main (and typically sole) centrifugal feed pump 114 which receives fiber suspension from the preceding treatment stage or a storage tower 110. The pulp enters the knotter section 112 of the unit 100 and is divided into two fractions of which the reject fraction $R_K$ is discharged to the stocker 116 and the accept fraction $A_K$ enters the primary screening section 120. In the knot washer 116 the reject fraction $R_K$ is divided into two fractions by washing the useable fibers out of the knot stock so that the accepted fiber material $A_{S1}$ is recycled to the suction side (inlet) of the main feed pump 114, with rejects to refiner 140, or for burning.

In the primary screening section 120 the fiber suspension, or the accept fraction of the knotter section 112, is again divided into two fractions of which the accept fraction $A_1$ is discharged from the screening unit 100 and for instance, introduced into a thickener 122, whereas the reject fraction $R_1$ flows to the secondary screening section 126.

In the secondary screening section 126 the reject fraction $R_1$ is still divided into two fractions of which the accept fraction $A_2$ is recycled preferably to the suction side of the main pump 114 and the reject fraction $R_2$ is discharged to the tertiary screening apparatus 128 where the rejects from $R_2$ are divided into two fractions. The accept fraction $A_3$ from the tertiary screening apparatus 128 is recycled to the suction side of the main feed pump 114, while rejects $R_3$ are disposed of (e.g., burned) or fed to refiner 140.

A sufficient number of dilution liquid connections D are provided in the system. FIG. 2 shows dilution liquid connections D for feeding dilution liquid to the knotter section 112, to the knot washer section 116, to the tertiary screening apparatus 128, and to the inlet of the main feed pump 114. Also the apparatus may be provided with light rejects removal as shown by LRR.

Figure 3:
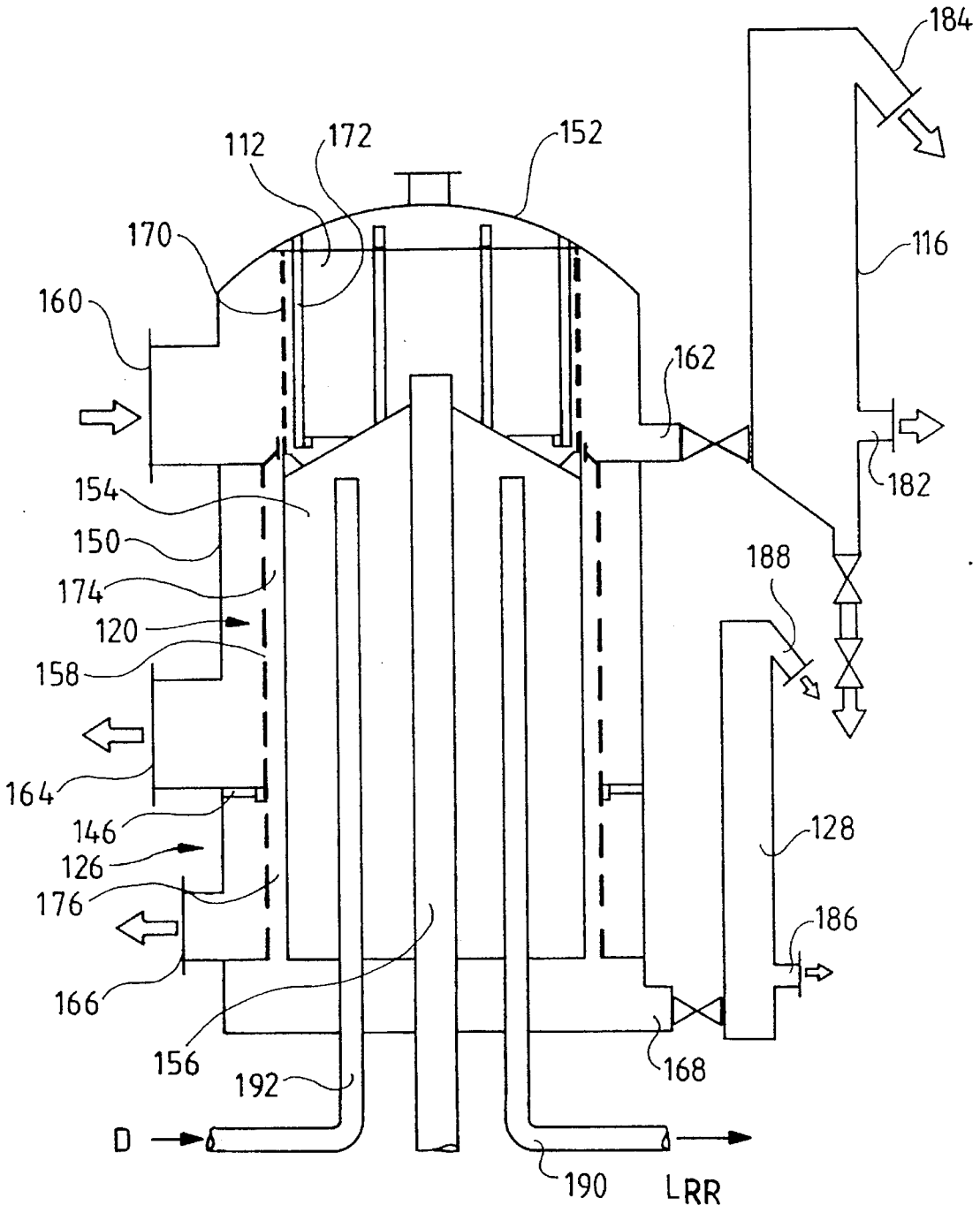
FIG. 3 is a side cross-sectional schematic view of a first embodiment of exemplary knotting and screening apparatus according to the present invention.

FIG. 3 shows an embodiment of a screening unit of the present invention which includes three sections (as illustrated only schematically in FIG. 2), i.e., the knotter section 112, the primary screening section 120 and the secondary screening section 126. In the embodiment shown in FIG. 3 the sections are disposed vertically one above the other in such a way that the knotter section 112 is at the top of the interior of a common housing 150 for the apparatus, the primary screening section 120 is in the middle, and the secondary screening section 126 at the bottom. The vertically disposed cylindrical main housing 150 has a top cover 152, and a dome shaped rotor 154 is disposed inside the housing 150 and connected by means of a shaft 156 to drive means (e.g., an electric motor, not shown). A screen cylinder, preferably formed of sections respectively, is disposed surrounding the rotor 154. The rotor 154 is a common, in-line, rotatable element for all of sections 112, 120 and 126.

The housing 150 is further provided with an inlet 160 for the stock to be treated, an outlet 162 for the rejects $R_K$ of the knotter section 112, an outlet 164 for the accepts A of the primary screening section 120, an outlet 166 for the accepts of the secondary screening section 126, and an outlet 168 for the rejects of the secondary screening section 126. The knotter section 112 includes, in accordance with this embodiment, a rotating perforated knotter cylinder 170 which is attached to the top of the rotor 154 and a plurality of stationary blades 172 attached to the top cover 152 of the housing 150. The stationary blades 172 and the perforated knotter cylinder 170 function together in a manner known per se. The knotter cylinder 170 is sealed against the screen cylinder 158 so that no fresh untreated stock is able to flow between the rotor 154 and the screen cylinder 158. The accepts fraction of the knotter section 112 firstly flows radially inwardly through the openings of the cylinder 170 and then downwardly onto the top of the rotor 154 and therealong radially outwardly between the bottom circumference of the knotter cylinder 170 and the top of the rotor 154 directly into the primary screening volume 174 between the rotor 154 and the screen cylinder upper section 158.

Rotation of the rotor 154 subjects the stock to circumferential forces tending to make the stock rotate in a circumferential direction. In a manner known per se, the accept fraction $A_1$ of the primary screening section 120 flows through the openings in the screen cylinder 158 and enters the accept volume and flows from there to the accept outlet 164. The accepts $A_1$ are further introduced, for instance, to a dewatering device such as a drum thickener. The reject fraction $R_1$, i.e., the fraction of the stock which has not passed through the screen cylinder upper section 158, flows gradually downwardly and enters the secondary screening section 126 and its screening volume 176. The object of the secondary screening section 126 is to treat the reject fraction $R_1$ in such a way that the fibers attached to heavier coarser particles are loosened therefrom and the fiber flocs break-up so that the major portion of the acceptable fibers of the reject fraction can be recovered. The accept fraction $A_2$ which has passed the lower screen cylinder section 159 enters the secondary accept volume and is discharged via the outlet 166, and is preferably recycled to the screening unit 100 in the manner shown in FIG. 2.

The reject fraction $R_K$ of the knotter section 112 is discharged via outlet 162 to a stocker 116 which may, in principle, be like the one shown in EP Patent Application 93890042. The accepts $A_{S1}$ of the knot washer 116 are discharged through outlet 182 and the rejects $R_{S1}$ through outlet 184. Preferably the accept fraction $A_{S1}$ received from the stocker outlet 182 is returned back to the fiber suspension flow into the pump 114 inlet of the screening unit 100. However, it is possible to use this fraction for other purposes too. The rejection fraction $R_{S1}$ of the stocker 116 received from outlet 184 may be transported to a refiner [140 in FIG. 2] for refining, or discharged from the entire mill to be, for instance, incinerated.

The rejects $R_2$ from the secondary screening section 126 are discharged, as explained earlier, via outlet 168 to the tertiary screening apparatus 128. Apparatus 128 is—in principle—a small sized stocker, like the one shown and described in EP Patent Application 93890042, though many different types of apparatus may be used for the same purpose. The accepts $A_3$ from the tertiary screening apparatus 128 are discharged from outlet 186 and, preferably, transported to the inlet of the main feed pump 114 of the screening unit 100. The rejects $R_3$ of the tertiary screening unit 128 are discharged from outlet 188 to be either refined (e.g., in refiner 140), incinerated, or used in some other way.

FIG. 3 also shows other optional equipment disposed in the screening unit housing 150. The inside of the rotor 154 is provided with two ducts 190 and 192, marked LRR and D, respectively. Duct 190 is used for removing light rejects from the inside of the rotor 154. If and when the stock to be treated includes light rejectable material like plastic particles, styrofoam etc., they tend to collect inside the rotor 154 so that the dome portion of the rotor 154 becomes filled with the light particles since they float on the surface of the fiber suspension inside the rotor 154. The operating principles of this structure are described in U.S. Pat. No. 4,634,521. The duct 192, is used for feeding dilution liquid D to the dome portion of the rotor 154 to enhance the separation of light rejects. The dilution liquid generally washes the fiber material out of the light rejectable material so that less fiber material is discharged along with the light rejects via duct 190. The use of the dilution liquid is described in more detail in Japanese Patent Application 1730405, the disclosure of which is incorporated by reference herein.

In accordance with a preferred embodiment of the invention the openings in the knotter cylinder 170 are substantially round, having a diameter of about 6 to 12 mm. The openings in the screen cylinder in the primary screening section 120 may be either round holes or elongated slots. If holes are provided, the diameter thereof is about 1.0–1.6 mm, and the diameters of the holes in the secondary screening section 126 are on the order of about 1.0–2.0 mm. If slots are provided the width thereof is about 0.20–0.40 mm, while the openings in the secondary screening section 126 are substantially round holes having a diameter of about 1.0–1.6 mm.

Figure 4:
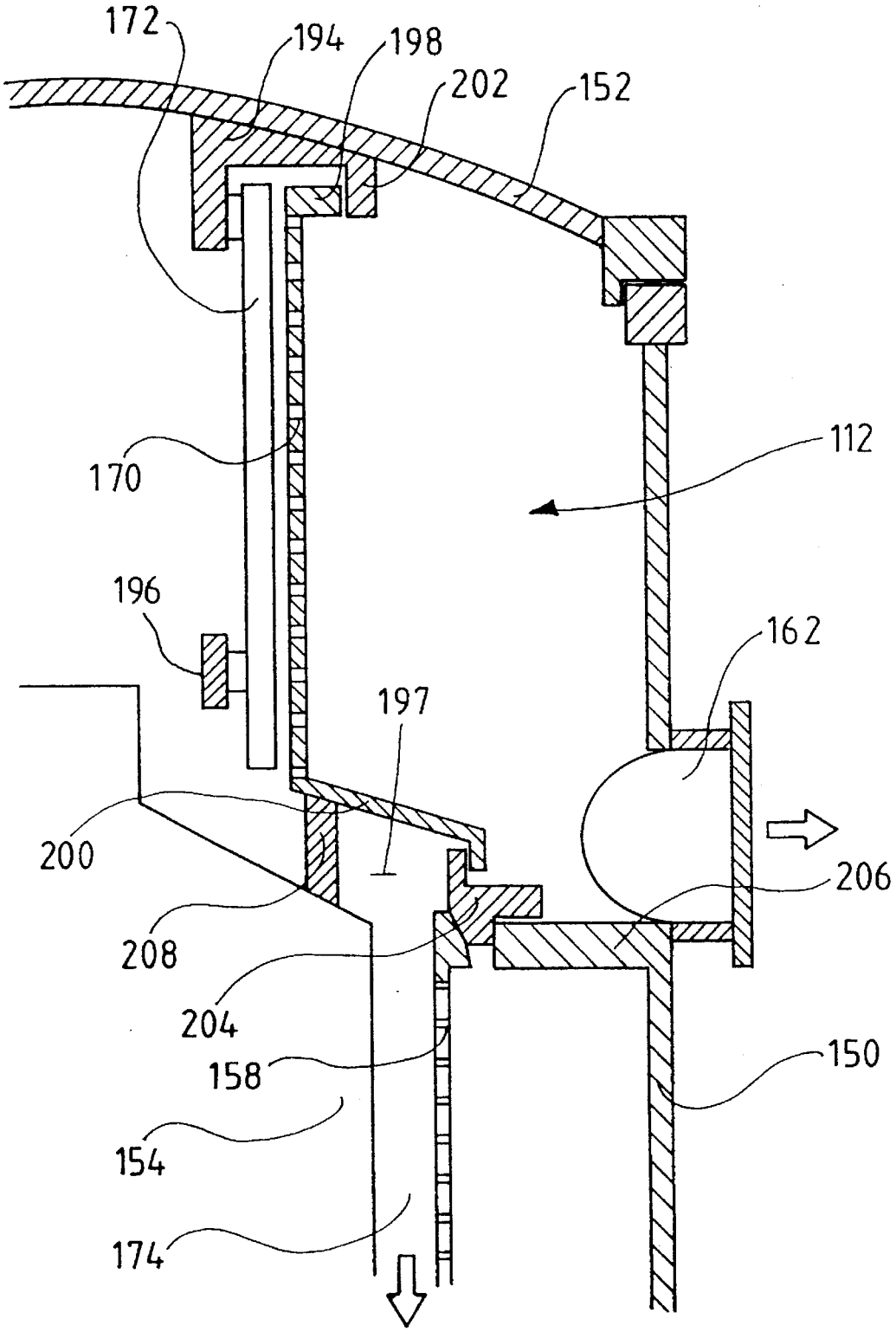
FIG. 4 is an enlarged, detailed view of the interface between the knotting and the primary screening stages of the apparatus of FIG. 3.

FIG. 4 shows an enlarged view of the knotter section 112 of the apparatus of FIG. 3. As already explained in connection with FIG. 3 the knotter section 112 of the screening unit consists of a knotter cylinder 170 attached to the rotor 154 and stationary blades 172 disposed inside the knotter cylinder 170 and attached to the top cover 152 of the screening unit 100. Onto the inside surface of the top cover 152 there is attached an annular ring 194 coaxial with the rotor 154. The blades 172 are attached at their upper ends to the ring 194 and at their lower ends to a cylindrical support ring 196 so that the distance between the blades 172 and the knotter cylinder 170 remains substantially the same throughout the whole length of the blades 172. The knotter cylinder 170 has two sealing members; an upper one 198 and a lower one 200. The upper sealing member 198 is, in this embodiment, a radially outwardly projecting flange facing corresponding sealing members 202 of the annular ring 194. The gap between the sealing members 198 and 202 is maintained small enough to substantially prevent leakage therethrough. The lower sealing member 200 is formed of an outwardly extending conical flange portion and a cylindrical flange portion at the outer end of the conical portion of the inner surface of the cylindrical flange portion faces a sealing member 204 which is attached between the screen cylinder 158 and a flange 206 extending radially inwardly of the housing 150 of the screening unit 100. The gap between the sealing members 200 and 204 is maintained small enough to substantially prevent leakage therethrough. The gap between the moving 200 and the stationary 204 sealing members may be provided with means for pumping the medium tending to flow into the gap away from the gap such means being disclosed in FI patent 79304, the disclosure of which is incorporated by reference herein.

The knotter cylinder 170 is attached to the top of the rotor 154 by means of legs 208 in such a manner that a wide enough gap 197 is provided between the conical flange 200 and the top of the rotor 154 to allow the accept fraction of the knotter to flow therethrough into the primary screening volume 174. As it is important for the function of the rotor 154 as well as the knotter cylinder 170 to have a certain circumferential speed, it is possible to adjust the corresponding diameters so that the speeds are the ones desired.

It is to be noted, however, that the details described above are exemplary only, and the apparatus may be constructed in many different ways. Therefore it is also possible that the gaps between the sealing members may well be axial instead of the radial gaps shown in FIG. 4. Also it is possible that no outwardly extending conical portion is provided where a high circumferential speed of the knotter cylinder is desired, so that the diameter of the knotter cylinder 170 may even be larger than the diameter of the rotor 154. Further, the sealing member 204 does not need to be part of a member between the screen cylinder 158 and the flange 206; it may, for instance, be a part of the flange 206, a part of the screen cylinder 158, or an entirely independent member attached on the housing 150 or on the flange 206.

Figure 5:
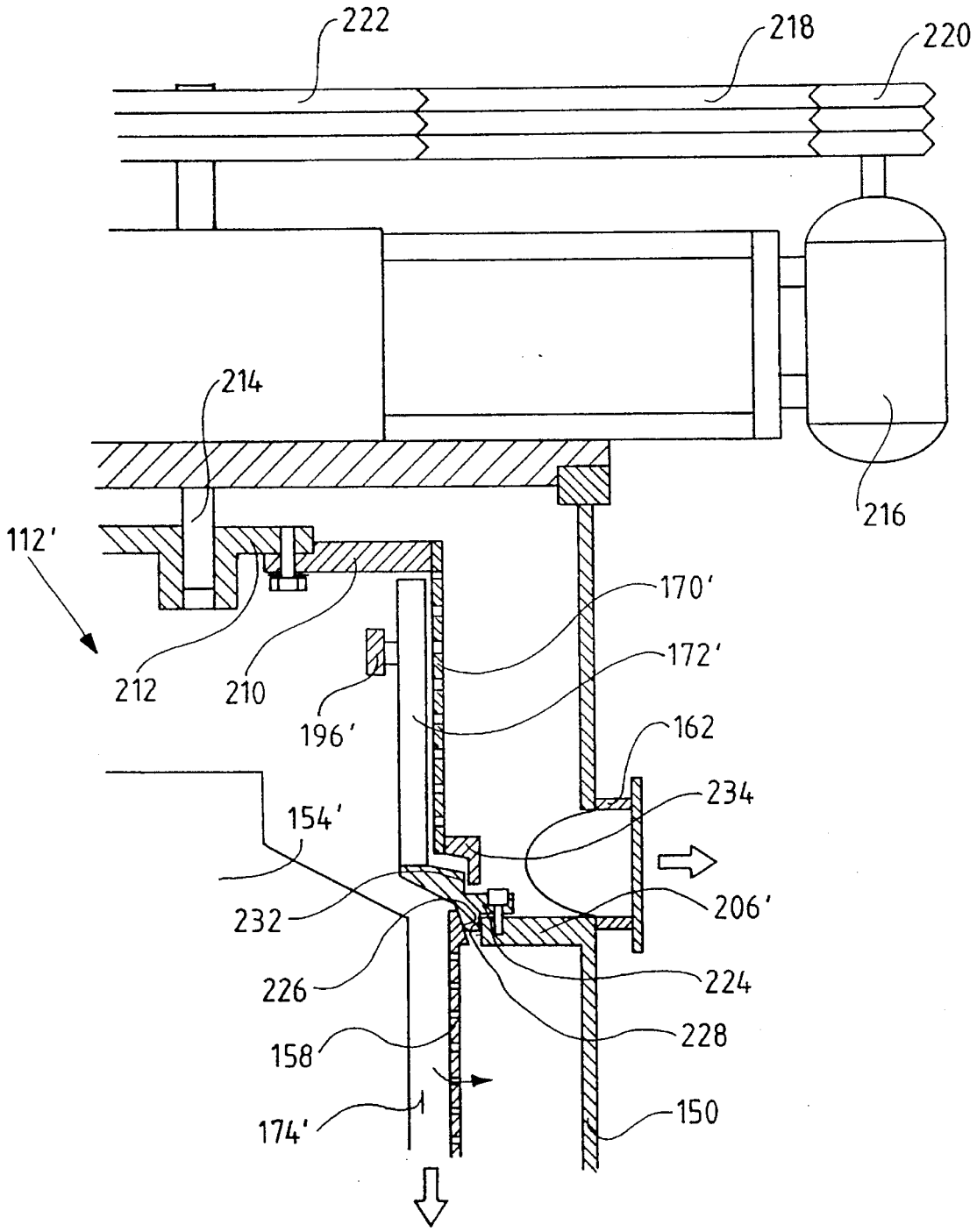
FIG. 5 is a view like that of FIG. 4 only of an alternative embodiment of apparatus according to the invention.

In FIG. 5 there is shown another preferred embodiment of the invention and especially of the knotter section 112' thereof. As in the FIG. 4 embodiment, the section 112' comprises a rotating knotter cylinder 170' and a plurality of stationary blades 172'. However, in accordance with this embodiment the knotter cylinder 170' is not attached to the rotor 154' but rather is mounted to be independently driven through the top cover 152' of the screening unit 100. The knotter cylinder 170' is attached by means of a radially inwardly extending flange (or arms) 210 and a radially outwardly extending flange 212 on a shaft 214 which is attached through the top cover 152' by means of bearings and seals (not shown). The shaft 214 is preferably driven by means of an electric motor 216 through, for instance, V-belts 218 so that the desired circumferential speed of the knotter cylinder 170' is achieved by defining the correct diameters of pulleys 220 and 222.

The stationary blades 172' are attached to the radial flange 206' extending inwardly from the housing 150 or in some other appropriate way. In the embodiment of FIG. 5 the base 224 of the blades 172' is used for fastening the screen cylinder 170' in place. In other words, the base 224 has a conical portion 226 facing a corresponding conical portion of the upper end of the screen cylinder. The inner edge of the flange 224 is coaxial with the rotor 154' and of equal diameter with the cylindrical portion 228 of the base 224 so that when the bolts 230 are tightened the base 224 with blades 172' moves axially downwardly and centers the screen cylinder 158 in place. The base 224 has also a cylindrical surface 232 above the conical portion 226 to provide sealing with a similarly cylindrical portion 234 of the knotter drum 170'. The purpose of this sealing is to prevent untreated material from entering the primary screening volume 174' between the screen cylinder 158 and the rotor 154'.

Figure 6:
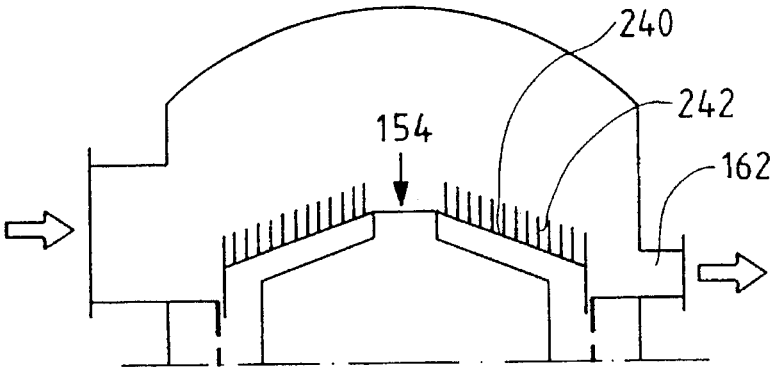
FIG. 6 is a schematic side cross-sectional view of merely the knotter section of exemplary apparatus like that of FIG. 3.

In FIG. 6 there is illustrated a further embodiment of the knotter section of the apparatus of the invention. The shaft of the rotor 154 is provided with outwardly projecting arms 240 spaced from the top of the rotor 154. The arms 240 carry a plurality of concentrically mounted circular rings 242 so that the spacing between the rings 242 define the knotter opening. The outer ends of the arms 240 are provided with a cylindrical sealing member for cooperation with, for instance, the upper end of the screen cylinder 158. The purpose of the knotter is to prevent knots, stones or metal particles from entering the primary screening section of the screening unit 100.

Figure 7:
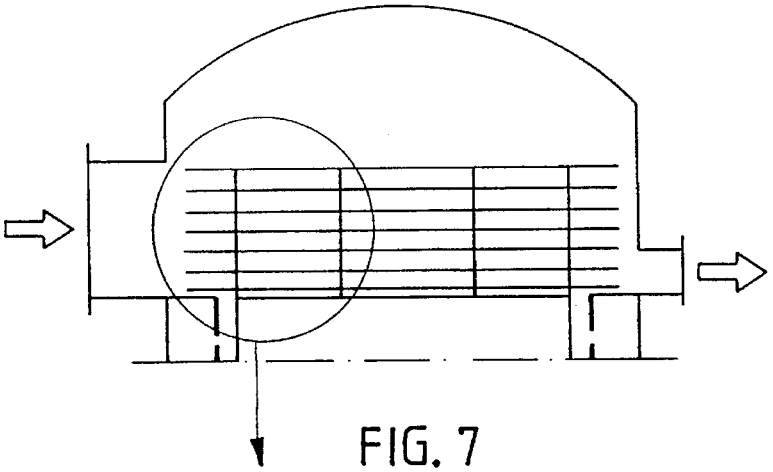
FIG. 7 is a view like that of FIG. 6 for an alternative embodiment.
Figure 7A:
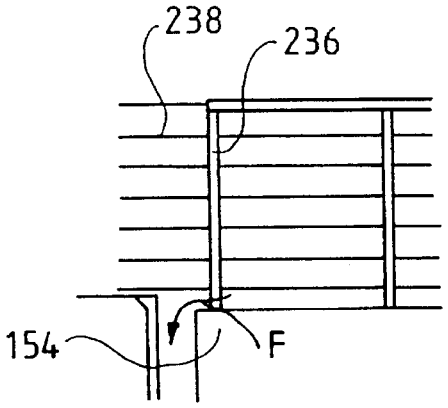
FIG. 7*a* is an enlarged view of a portion of the apparatus of FIG. 7.

In FIG. 7 there is shown a still further embodiment of the knotter section of the invention. Basically the operational principle of the knotter of FIG. 7 is the same as the one of the knotter of FIG. 6. However, in the embodiment of FIG. 7 (see FIG. 7*a*) the arms 236 extend substantially is vertically and are attached to the top of the rotor 154, preferably close to the outer circumference of the rotor 154. The arms 236 are provided with a plurality of adjacent annular radial rings of like members mounted in a substantially radial plane so that they form knotter openings therebetween. The accepted fraction flows from the top of the rotor 154 into the primary screening section 120 as shown by arrow F. In accordance with a preferred embodiment the lowermost plate forms a sealing between the upper edge of the screen cylinder or some other appropriate member in order to prevent undesirable material from entering the primary screening volume. Also the uppermost member may be a solid plate forming a cover for the knotter section. Another way to prevent the untreated pulp from entering inside the knotter "cylinder" is to extend the arms 236 up to the close proximity of the top cover 152 of the housing and provide the upper ends of the arms with a ring forming a sealing between the top cover and the knotter "cylinder." A preferred way of providing such a seal is shown in FIG. 4.

Figure 8A:
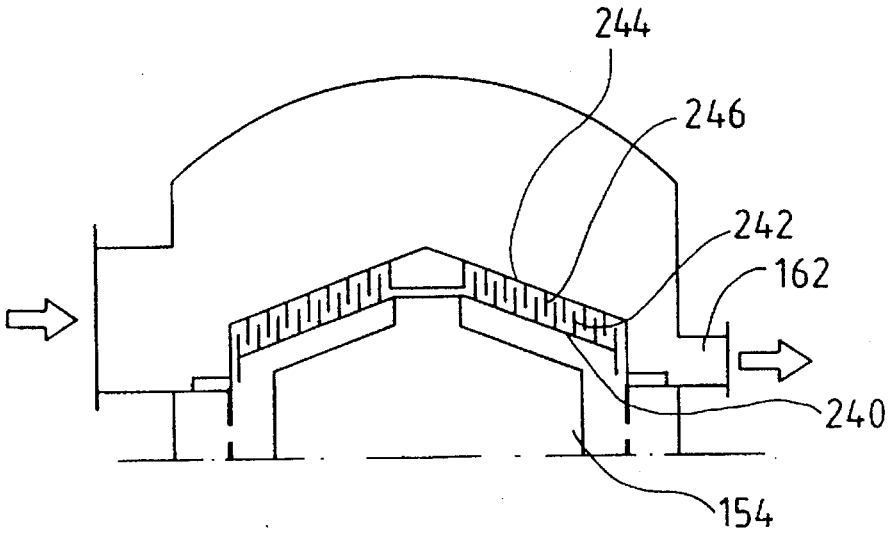
FIG. 8*a* is a view like that of FIG. 7 for yet another embodiment according to the present invention.
Figure 8B:
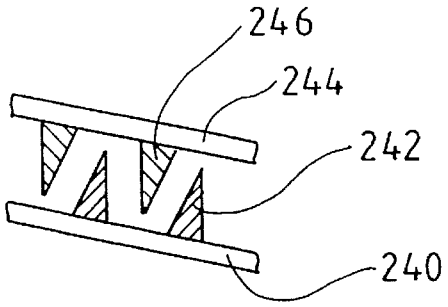
FIGS. 8*b* and 8*c* are detail side views, partly in cross-section and partly in elevation, of cooperation between components of the knotter of FIG. 8*a;*
Figure 8C:
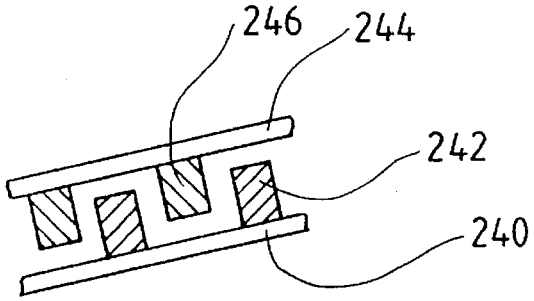

In FIGS. 8*a*, 8*b* and 8*c* there is illustrated yet another preferred embodiment of the invention and especially of the knotter section thereof. FIG. 8*a* shows the general concept of the knotter section. It consists of a plurality of outwardly extending arms 240 or like members which are attached on the same shaft with the rotor 154 preferably at a distance above the top of the rotor 154. The arms 240 are provided with adjacent coaxial annular rings 242 which provide a radial space therebetween. There are a plurality of stationary arms 244 or like members attached above the arms 240, for instance, like the base 224 of the wings 172' in FIG. 5. The stationary arms 244 are provided with a number of annular coaxial rings 246 leaving a radial space therebetween in such a manner that rings 246 fit into the spaces between rings 242 and vice versa. In the way described above a knotter screen has been developed where the screen is formed of a number of adjacent annular screening slots. The purpose of the knotter screen is both to prevent large impurities from entering the primary screening section 120 below the knotter, and to create turbulence for breaking up large fiber flocs so that as much desirable fiber as possible is introduced into the primary screening section 120. FIGS. 8*b* and 8*c* show some alternatives for the cross-sectional configuration of the annular rings. In FIG. 8*b* the cross-section of the rings is triangular and in FIG. 8*c* rectangular.

Figure 9:
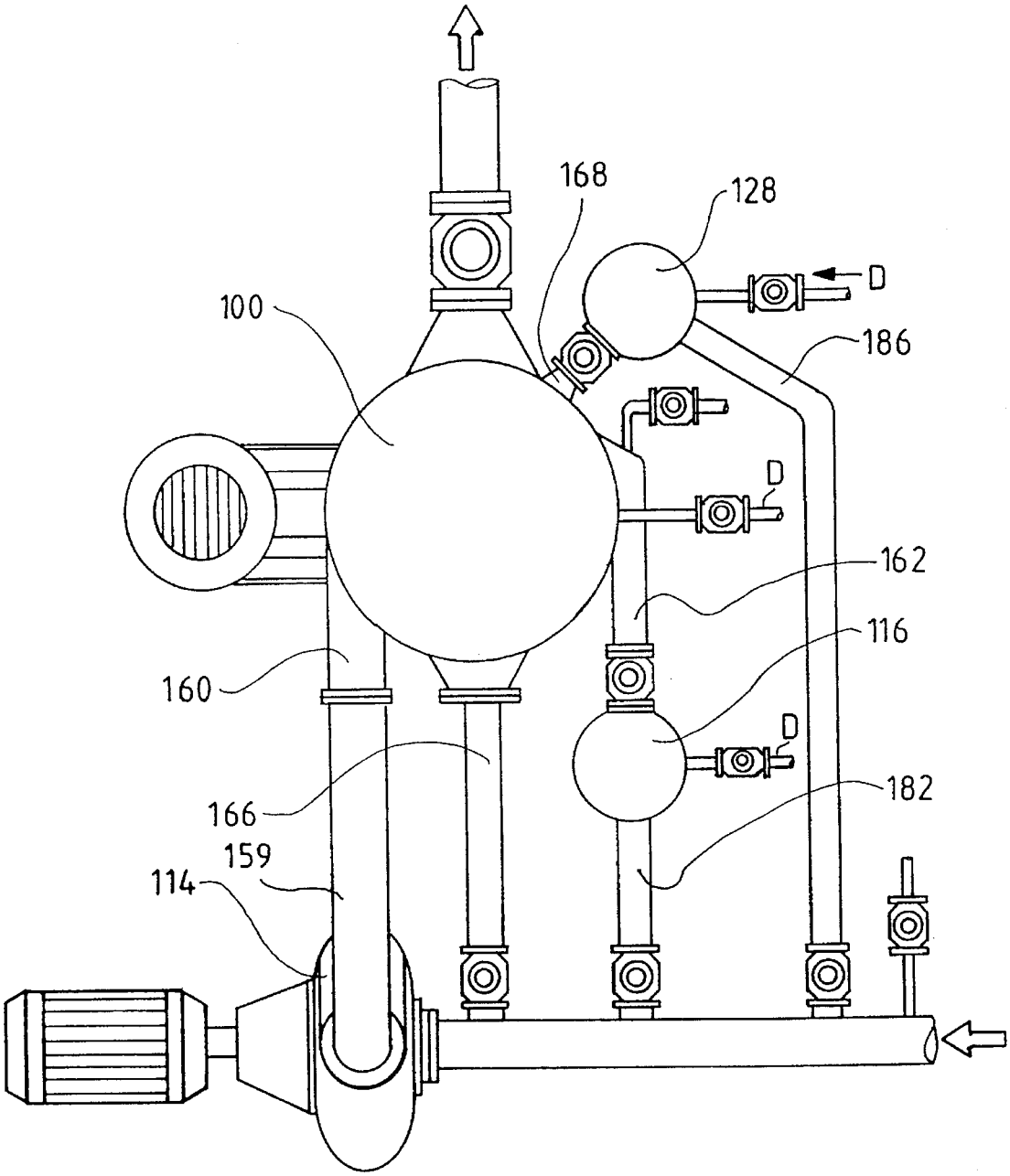
FIG. 9 is a top plan view of exemplary apparatus shown only schematically in FIG. 2.

FIG. 9 shows the layout of a preferred embodiment of the apparatus of the invention. The layout corresponds to the one shown in FIG. 2 but FIG. 9 describes the mutual location of the different apparatus. In the center of the arrangement is the screening unit 100 to which the fiber suspension to be treated is supplied by the main feed pump 114. By means of a correct design of the apparatus involved and correct positioning with respect to each other it is possible to connect pump 114 to screening unit 100 with a very short pipe (less than two meters long, e.g., less than one meter), or with no additional piping at all. In other words, in accordance with a preferred embodiment the outlet, or pressure flange 159, of the sole pump 114 is directly attached to the inlet flange 160 of the screening unit 100. If this is compared to the prior art system of FIG. 1, where the main feed pump 14 is on the lower floor of the building and connected to the screen 12 by means of a vertical pipe having a length of about 10 meters, it is easy to see the difference. Accordingly the screening unit 100 is directly connected to the knot washer 116 and to the tertiary screening apparatus 128 with its appropriate conduits 162 and 168, preferably flange to flange connections without any additional conduits. The only conduits needed in the arrangement are those connecting the main screening unit 100, the knot washer 116, and the tertiary screening apparatus 128, to the suction side of the main feed pump 114. However, the length of these conduits may be optimized such that the total length of the conduits is negligible, (i.e., less than two meters, preferably less than one meter). All the apparatus is thus easily mounted on the same story of an enclosed building.

Figure 10:
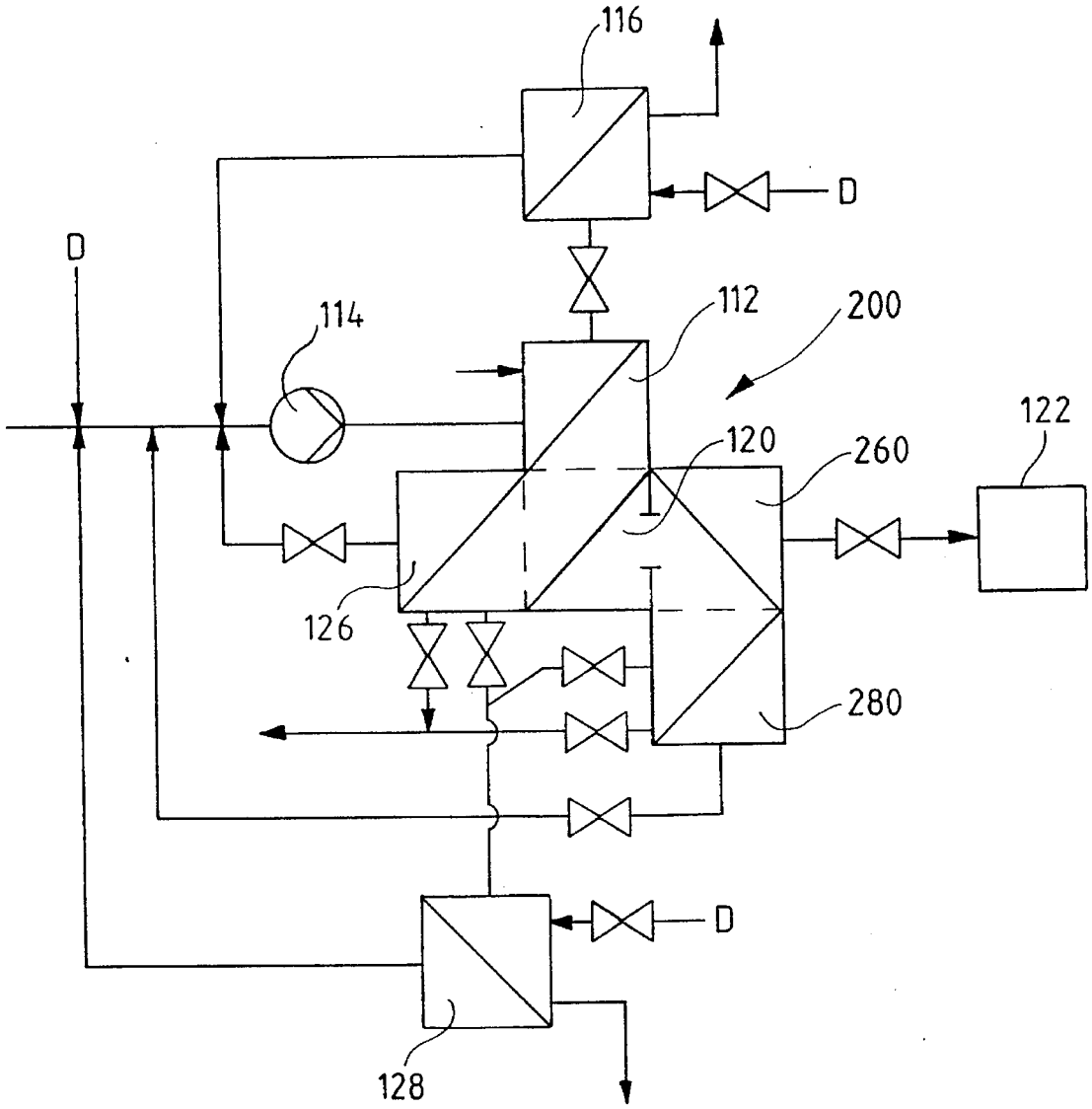
FIG. 10 is a schematic illustration like that of FIG. 2 only for a modified form of apparatus according to the invention.

FIG. 10 schematically illustrates yet another preferred embodiment of the present invention. The basic arrangement is the same as shown in FIG. 2, accordingly, the same reference numerals are used herein, too.

The apparatus of FIG. 10 is provided with two additional screening stages arranged directly at the accepts outlet of the primary screening section 120, in other words, the additional screening stages are attached to the accepts outlet 164 of FIG. 3. The additional two screening stages are the second screening stage 260 and the third screening stage 280, all part of the primary stage 120. In accordance with the embodiment of FIG. 10 the accept fraction of the second screening stage 260 is conveyed to thickener 122, or used in the next treatment step. The reject fraction flows to the third screening stage 280 where it is divided into two fractions; an accepts fraction which is preferably returned to the inlet of the sole pump 114, and a reject fraction which is introduced with the reject fraction of the secondary screening stage 126 into a tertiary screening stage 128.

The apparatus performing the second and third screening stages 260 and 280 may, in principle be like the one shown in FIG. 3 except that the knotter section thereof is deleted. The apparatus may be provided with light rejects removal LRR as discussed earlier in connection with FIG. 3.

In accordance with a preferred embodiment the screen cylinders in the knotter section 112, the primary screening section 120, and the third screening stage 128 are provided with round holes, whereas in the second screening stage 126 the screen cylinder is provided with narrow slots.

The screen cylinders used in the knotter section 112 and in the two following screening sections 120, 126 may be of different types. The knotter cylinder is either a smooth screen cylinder or a contoured screen cylinder having ridges between the rows of openings. Both the contoured and smooth screen cylinders may be provided with either round holes, slots or combinations thereof. The cylinders in sections 120, 126 are preferably contoured.

In both the FIGS. 2 and 10 embodiments, the pump 114 pressurizes the cellulose pulp to a first pressure (which is higher than a discharge pressure for the pulp) so that under substantially the sole influence of the first pressure, without repressurizing, deknotting, primary screening, and secondary screening of the pulp take place in the knotting 112, primary screening 120, and secondary screening 126 sequential stages. The stages are positioned so that each stage is less than two meters from the next stage, preferably in a common housing as already described. Dilution liquid is fed into the pulp in at least one of the stages, and where needed.

It will thus be seen and according to the present invention an advantageous apparatus and method for effecting screening of cellulose pulp and like fiber suspensions is provided. While the invention has been herein shown and described and whereas presently conceived to be the most practical and preferred embodiment thereof it will be apparent to those of ordinary skill in the art the many modifications may be made thereof within the scope of the invention, which scope is to be accorded the broadest interpretation of the appended claims so as to encompass all equivalent structures and processes.

What is claimed is:

1. A fiber suspension treatment apparatus comprising:

a pump having an inlet and an outlet and for pumping fiber suspension out of said outlet;

a knotter having a rotatable knotter cylinder with a first diameter;

at least one screening stage comprising a stationary screen cylinder having a second diameter, and a rotor having a third maximum diameter portion, and disposed on the opposite side of said knotter from said pump;

said knotter cylinder connected to said rotor to rotate with said rotor;

a common housing containing said knotter and said at least one screening stage;

said pump outlet connected to said knotter and said at least one screening stage to provide substantially the sole motive force to a fiber suspension to move the fiber suspension through said knotter and said at least one screening stage; and said third diameter being smaller than said second diameter and said first diameter being smaller than said third diameter so that upon rotation of said rotor the circumferential speed of said knotter cylinder differs from the circumferential speed of said rotor maximum diameter portion.

2. Apparatus as recited in claim 1 wherein said knotter includes a rejects discharge, and further comprising a knot washer connected to said rejects discharge; said knot washer including an accepts outlet, and said knot washer accepts outlet connected to said pump inlet.

3. Apparatus as recited in claim 2 wherein said at least one screening stage comprises primary and secondary stages; and further comprising a recycle conduit from said secondary screening stage to said pump inlet, said recycle conduit less than two meters in length.

4. Apparatus as recited in claim 3 wherein said secondary screening stage includes a rejects outlet; and further comprising a tertiary screening stage, and a second conduit connecting said secondary stage rejects outlet to said tertiary screening stage, said second conduit having a length less than two meters.

5. Apparatus as recited in claim 4 wherein said tertiary screening stage includes an accepts outlet; said tertiary screening stage accepts outlet connected to said pump inlet by a third conduit which has a length of less than two meters.

6. Apparatus as recited in claim 4 further comprising a first valve in said recycle conduit and a second valve in said second conduit.

7. Apparatus as recited in claim 6 further comprising a third conduit having a length of less than two meters connecting said knot washer to said knotter rejects discharge, and a third valve in said third conduit.

8. Apparatus as recited in claim 1 wherein said at least one screening stage comprises primary and secondary stages; and further comprising an accepts outlet from said primary screening stage, and further comprising at least one additional screening stage having an inlet positioned less than two meters from said accepts outlet and connected to said accepts outlet.

9. Apparatus as recited in claim 1 wherein said at least one screening stage comprises primary and secondary stages; and further comprising a single motor for simultaneously powering said knotter and screening stages.

10. Apparatus as recited in claim 9 wherein said single motor simultaneously rotates rotatable elements of said knotter and screening stages.

11. Apparatus as recited in claim 9 wherein said knotter is located immediately vertically above said primary screening stage, and said primary screening stage is immediately above said secondary screening stage.

12. Apparatus as recited in claim 11 wherein said knotter and screening stages are in a common housing, and wherein said single motor is mounted on a top portion of said common housing and is connected to said rotatable elements by a drive element.

13. Apparatus as recited in claim 12 wherein said drive element comprises a plurality of drive belts.

14. Apparatus as recited in claim 9 wherein said single motor is mounted on a top portion of said housing.

15. Apparatus as recited in claim 1 wherein said at least one screening stage comprises primary and secondary stages; and wherein said knotter is located immediately vertically above said primary screening stage, and said primary screening stage is immediately above said secondary screening stage, and further comprising dilution liquid conduits connected to at least one of said knotter and screening stages; and wherein all of said pump, knotter, and screening stages are on the same story of an enclosed building.

16. Apparatus as recited in claim 1 further comprising dilution liquid conduits connected to at least one of said knotter and screening stages; and wherein all of said pump, knotter, and screening stages are on the same story of an enclosed building.

17. Apparatus as recited in claim 1 wherein said at least one screening stage comprises primary and secondary screening stages; and further comprising a continuous pathway for fiber suspension within said housing extending from said knotter to said primary stage and then to said secondary stage.

18. A fiber suspension treatment apparatus comprising:

a housing;

a knotter disposed in said housing and having a first rotatable element;

a primary screening stage disposed in said housing and having a second rotatable element;

a secondary screening stage disposed in said housing and having a third rotatable element;

a first accepts discharge leading from said knotter directly to said primary screening stage, and a first rejects discharge;

a second accepts discharge leading from said primary screening stage directly to said secondary screening stage, and a second rejects discharge;

a third accepts discharge from said secondary screening stage, and a third rejects discharge; and said primary screening stage comprising first, second and third screening stages, the accepts from one stage leading directly to the next stage.

19. A method of screening cellulose pulp comprising the steps of:

(a) pressurizing cellulose pulp to a first pressure which is higher than a discharge pressure for the pulp;

(b) under substantially the sole influence of the first pressure, without repressurizing, effecting deknotting, primary screening, and secondary screening of the pulp in knotting, primary screening, and secondary screening sequential stages;

(c) positioning the stages so that each stage is less than two meters from the next stage; and (d) recirculating rejects from the secondary screening stage back to the deknotting stage substantially solely under the influence of the first pressure.

20. A method as recited in claim 19 comprising the further step of discharging rejects from the knotting stage and passing the rejects from the knotting stage through a knot washer substantially solely under the influence of the first pressure, without repressurizing.

21. A method as recited in claim 20 comprising the further steps of discharging accepts from the primary and secondary screening stages substantially solely under the influence of the first pressure, without repressurizing.

22. A method as recited in claim 19 wherein step (c) is practiced by disposing the deknotting and primary and secondary screening stages in a common housing, pulp from one stage directly immediately passing to the next stage.

23. A method as recited in claim 22 wherein step (c) is further practiced by disposing the stages one atop the other, and wherein deknotting and primary and secondary screening operations in the deknotting and primary and secondary screening stages are practiced by effecting rotation of a common rotatable element extending between the deknotting and primary and secondary screening stages.

24. A method as recited in claim 19 comprising the further step of feeding dilution liquid into the pulp in at least one of the deknotting and primary and secondary screening stages.

25. A fiber suspension treatment apparatus comprising:

a pump having an inlet and an outlet and for pumping fiber suspension out of said outlet;

a knotter having a rotatable knotter cylinder;

at least one screening stage comprising a stationary screen cylinder and a rotor, and disposed on the opposite side of said knotter from said pump;

a common housing containing said knotter and said at least one screening stage;

said pump outlet connected to said knotter and said at least one screening stage to provide substantially the sole motive force to a fiber suspension to move the fiber suspension through said knotter and said at least one screening stage;

a first drive connected to and driving said rotor; and a second drive, independent from said first drive, connected to and driving said knotter cylinder.

26. Apparatus as recited in claim 25 wherein said second drive comprises a motor mounted on a top portion of said housing.

27. Apparatus as recited in claim 26 wherein said at least one screening stage comprises primary and secondary stages; and wherein said housing is vertically oriented so that said knotter is directly above said primary screening stage, and said primary screening stage is directly above said secondary screening stage.

28. Apparatus as recited in claim 25 wherein said at least one screening stage comprises primary and secondary screening stages; and further comprising a continuous pathway for fiber suspension within said housing extending from said knotter to said primary stage and then to said secondary stage.

29. A fiber suspension treatment apparatus comprising:

a pump having an inlet and an outlet and for pumping fiber suspension out of said outlet;

a knotter having a first rotatable element;

first and second screening stages comprising a common stationary screen cylinder, and a common rotor, and disposed on the opposite side of said knotter from said pump;

a common housing containing said knotter and said screening stages;

said pump outlet connected to said knotter;

a first accepts discharge leading from said knotter directly to said primary screening stage and a first rejects discharge;

a second accepts discharge leading from said primary screening stage directly to said second screening stage, and a second rejects discharge; and a third accepts discharge from said secondary screening stage, and a third rejects discharge.

30. Apparatus as recited in claim 29 wherein said first rejects discharge is connected to a knot washer exterior of said housing by a first conduit having a length of less than two meters, said first conduit having a valve therein.

31. Apparatus as recited in claim 29 wherein said third rejects discharge is connected to a tertiary screening stage exterior of said housing by a second conduit having a length less than two meters, said second conduit having a valve therein.

32. Apparatus as recited in claim 29 wherein said first rotatable element is connected to said rotor for rotation therewith, and to a common drive for driving said rotor and said first rotatable element.

33. Apparatus as recited in claim 32 wherein said first rotatable element comprises a knotter cylinder having a first diameter; and wherein said common cylinder has a second diameter greater than said first diameter; and wherein said rotor has a third maximum diameter portion, said first diameter being smaller than said third diameter so that upon rotation of said rotor the circumferential speed of said knotter cylinder differs from the circumferential speed of said rotor maximum diameter portion.

34. Apparatus as recited in claim 29 wherein said first rotatable element is driven by a first drive, and said rotor is driven by a second drive independent from said first drive.

35. A method of screening cellulose pulp comprising the steps of:

(a) pressurizing cellulose pulp to a first pressure which is higher than a discharge pressure for the pulp;

(b) under substantially the sole influence of the first pressure, without repressurizing, effecting deknotting, primary screening, secondary screening, tertiary screening of the pulp in knotting, primary screening, secondary screening, and tertiary screening sequential stages;

(c) positioning the stages so that each stage is less than two meters from the next stage; and (d) introducing rejects from the secondary screening stage to the tertiary screening stage.

36. A method as recited in claim 35 comprising the further step of recirculating rejects from the secondary screening stage back to the deknotting stage substantially solely under the influence of the first pressure.

* * * * *